US007346148B2

(12) United States Patent
Ukita

(10) Patent No.: US 7,346,148 B2
(45) Date of Patent: Mar. 18, 2008

(54) X-RAY GENERATING APPARATUS

(75) Inventor: Masaaki Ukita, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 11/646,338

(22) Filed: Dec. 28, 2006

(65) Prior Publication Data

US 2007/0110217 A1 May 17, 2007

Related U.S. Application Data

(62) Division of application No. 11/084,801, filed on Mar. 21, 2005, now Pat. No. 7,215,741.

(30) Foreign Application Priority Data

Mar. 26, 2004 (JP) ..... 2004-092076

(51) Int. Cl.
*H01J 35/08* (2006.01)

(52) U.S. Cl. ..... 378/143; 378/119

(58) Field of Classification Search ..... 378/119, 378/121, 125, 126, 137, 141, 143, 144
See application file for complete search history.

(56) References Cited

U.S. PATENT DOCUMENTS 5,420,906 A 5/1995 Smit et al.
5,857,008 A * 1/1999 Reinhold ..... 378/137
7,215,741 B2 * 5/2007 Ukita ..... 378/143
2005/0213711 A1 * 9/2005 Ukita ..... 378/141

FOREIGN PATENT DOCUMENTS

JP 2000-082430 3/2000
JP 2000-306533 11/2000
JP 2002-025484 1/2002

* cited by examiner

*Primary Examiner*—Courtney Thomas
(74) *Attorney, Agent, or Firm*—Cheng Law Group PLLC

(57) ABSTRACT

This invention relates to a microfocus X-ray tube having a heat-dissipation solid formed on the target adhesively. Specifically, the heat-dissipation solid defining an opening is formed on the target surface irradiated with an electron beam. Heat generated adjacent the target surface by impingement of an electron beam having passed through the opening is promptly distributed by heat conduction through the surface solid. The heat-dissipation solid contributes to lowering of a surface temperature of the target layer with which the electron beam collides, and a reduction of evaporation of a material forming the target, thereby extending an X-ray generating time.

1 Claim, 14 Drawing Sheets

Fig. 23

| | | k2 | | | | | | | | |
|---|---|---|---|---|---|---|---|---|---|---|
| | | 2 | 3 | 4 | 5 | 6 | 7 | 8 | 9 | 10 |
| k1 | 1 | 1.8 | 2.3 | 2.7 | 3 | 3.2 | 3.4 | 3.6 | 3.8 | 3.9 |
| | 2 | | 4.5 | 5.2 | 5.8 | 6.3 | 6.7 | 7.1 | 7.4 | 7.7 |
| | 3 | | | 6.7 | 7.4 | 8.1 | 8.7 | 9.2 | 9.7 | 10.1 |
| | 4 | | | | 8.8 | 9.6 | 10.3 | 10.9 | 11.5 | 12.1 |
| | 5 | | | | | 10.8 | 11.6 | 12.4 | 13.1 | 13.7 |
| | 6 | | | | | | 12.8 | 13.7 | 14.5 | 15.2 |
| | 7 | | | | | | | 14.9 | 15.7 | 16.6 |
| | 8 | | | | | | | | 16.9 | 17.8 |
| | 9 | | | | | | | | | 18.9 |

X-RAY GENERATING APPARATUS

CROSS REFERENCE TO RELATED APPLICATIONS

The present application is a Divisional Application of the patent application Ser. No. 11/084,801, filed on Mar. 21, 2005 now U.S. Pat. No. 7,215,741, which is based on Japanese Priority Document JP2004-092076, filed in the Japanese Patent Office on Mar. 26, 2004, the entire contents of which are incorporated herein by reference.

BACKGROUND OF THE INVENTION (1) Field of the Invention

This invention relates to an X-ray generating apparatus for a non-destructive X-ray inspecting system or X-ray analyzing system. Particularly, the invention relates to an apparatus having a very small X-ray source sized in the order of microns to obtain fluoroscopic images of a minute object. More particularly, the invention relates to a microfocus X-ray tube.

(2) Description of the Related Art

Conventionally, X-ray generating apparatus of the type noted above are operable according to the following principle. First, electrons (Sa [A]) are emitted from an electron source maintained at a high negative potential (−Sv [V]) in a vacuum, and are accelerated by a potential difference between the electron source and ground potential 0V. Next, the accelerated electrons are converged to a diameter of 20 to 0.1 μm with an electron lens. The converged electron beam collides with a solid target formed of metal (e.g. tungsten or molybdenum), thereby realizing an X-ray source sized in the order of microns. A maximum energy of X-rays generated at this time is Sv [keV], and the X-ray focal size approximately corresponds to the diameter of the converged electron beam.

An especially high-resolution apparatus among these X-ray generating apparatus is an X-ray tube called a transmission microfocus X-ray generating apparatus. The X-ray tube has a target structure including a vacuum window in the form of an X-ray transmission plate of aluminum or beryllium. The vacuum window has a target metal formed in a thickness of 2 to 10 μm on a vacuum side surface thereof. The X-rays generated by an electron beam colliding with the target metal pass through the vacuum window in the direction of the incident electron beam and are utilized in the atmosphere.

In such a transmission X-ray generating apparatus, an inspection object and an X-ray focus are set close to each other by an extent corresponding to the thickness of the vacuum window to enable, geometrically, high magnification X-ray radiography, thereby to obtain fluoroscopic images of high spatial resolution. Such an X-ray tube is used in an inspection apparatus for searching for minute defects in an inspection object. These inspecting operations will sometimes take several hours per object (see Japanese Unexamined Patent Publication No. 2002-25484 and Japanese Unexamined Patent Publication No. 2000-306533, for example).

However the portion of the target where an electron beam collides becomes high temperature and the target material evaporate and wear away, the X-ray tube will cease emitting X-rays in due time. To overcome this inconvenience, it has been proposed, in the case of a reflection type X-ray tube, to form a heat dissipation layer on an internal layer opposite the electron-colliding surface of the target, to restrain a temperature rise of the target by utilizing heat conduction (see Japanese Unexamined Patent Publication No. 2000-082430, for example).

The conventional microfocus X-ray tube according to the above operation principle has the following problems.

Since a fine converged electron beam collides with the target, a temperature rise concentrates adjacent an electron beam colliding spot on the target surface, thereby tending to evaporate the target material. The evaporation will result in the inconvenience of enlarging the X-ray focus or failing X-rays, which requires a maintenance operation such as a change of the X-ray tube or the target. When a powerful electron beam is emitted in order to increase X-ray dosage, the target material will evaporate momentarily to render the increase in X-ray dosage impossible.

SUMMARY OF THE INVENTION

This invention has been made having regard to the state of the art noted above, and its primary object is to provide an X-ray generating apparatus with improved local heat-dissipation performance of a target, for extending the life of the target, increasing the operating ratio of the apparatus, and improving X-ray intensity.

The above object is fulfilled by this invention; an X-ray generating apparatus comprising a heat-dissipation layer in contact with a surface of the target irradiated with the electron beam.

With the X-ray generating apparatus according to this invention, the heat-conduction of the heat-dissipation layer immediately distributes the heat locally generating at a colliding point of the electron beam, and reduces a local temperature rise at the target surface. This reduces evaporation of the target material around the electron beam irradiation position. As a result, the life of the target may be extended, and the operating ratio of the apparatus may be increased with a reduced frequency of changing and adjusting the target. Similarly, X-ray intensity may also be increased.

Preferably, the heat-dissipation layer defines an opening or bore at an electron beam irradiating position.

With this construction, the heat-dissipation layer does not block the course of the electron beam while allowing the electron beam to irradiate the target layer as in the prior art, and the heat-conduction of the heat-dissipation layer immediately distributes the heat locally generating at the colliding point of the electron beam, and reduces a local temperature rise at the target surface. This reduces evaporation of the target material around the electron beam irradiation position. As a result, the life of the target may be extended, and the operating ratio of the apparatus may be increased with a reduced frequency of changing and adjusting the target. Similarly, X-ray intensity may also be increased Preferably, the heat-dissipation layer is formed by a film forming method and a masking method. The heat dissipation layer can be formed easily by using the film forming method. The masking method can form a smallest opening corresponding to the diameter of the converged electron beam with high precision. Thus, the heat-dissipation layer may be formed close to the electron beam colliding position to increase the heat dissipating effect.

Preferably, the heat-dissipation layer is formed by a film forming method and precision machining. The heat-dissipation layer can be formed easily by using the film forming method. Precision machining can form a small opening corresponding to the diameter of the converged electron beam with high precision. Thus, the heat-dissipation layer may be formed close to the electron beam colliding position to increase the heat dissipating effect. Moreover, the shaping process is simplified and cost is reduced.

It is preferred that, after forming the heat-dissipation layer on the surface of the target, the target is attached to an X-ray tube, and the opening is formed by the electron beam of the X-ray tube. In other word, the opening is formed by irradiating the heat-dissipation layer with the same electron beam as that for generating X-rays. Therefore, there is no work to adjust the irradiating position to generate X-rays explicitly. Further, since the X-ray tube can be assembled in a simplified operation, the assembling time is shortened and the X-ray tube is manufactured at low cost, and the opening may be formed easily compared with the masking method or the precision machining.

Preferably, the opening of the heat-dissipation layer is formed within 17 times a radius of the electron beam from a center of the electron beam irradiation position.

This construction can efficiently lower the temperature of the electron beam irradiation position by the heat conduction of the heat-dissipation layer.

Preferably, the heat-dissipation layer has a thickness greater than a radius of the electron beam.

This construction can efficiently lower the temperature of the electron beam irradiation position by the heat conduction of the heat-dissipation layer. The amount of heat-conduction is proportional to the volume that carries heat. Thus, by forming the heat-dissipation layer to have a thickness greater than the radius of the electron beam, the temperature of the electron beam irradiation position is lowered efficiently.

Preferably, the opening is formed in a tapered shape so that an inner wall of the opening converges in a proceeding direction of the electron beam.

With this construction, the opening shape is similar to the tapered shape electron beam with the forward end converged (reduced in size) in the proceeding direction by a lens. That is, this construction can guide the electron beam to the target surface without obstructing the electron beam through the opening. Moreover, the heat-dissipation layer can cover the target regions adjacent to the collision point of the electron beam reduced to a minute diameter. Thus, the temperature of the electron beam irradiation position can be reduced efficiently.

The heat-dissipation layer may include a plurality of layers laminated upward from the target surface, or include a plurality of layers arranged adjacent one another radially of the electron beam.

These constructions enables some optimal multilayer design that takes into consideration the amount of evaporation and thermal conductivity of the layer material, to promote the heat-dissipation effect and heat resistance. That is, compared with the heat-dissipation layer formed of a single material, this heat-dissipation multilayer may be better suited for the using purpose of the X-ray tube.

Preferably, the closer layers to the electron beam irradiation position are formed of materials having the higher melting points.

This construction can reduce evaporation of the highest temperature portion of the heat-dissipation layers which become higher temperature as closer to the electron beam. That is, this construction utilizes the fact that a material of the higher melting point evaporates in the less amount. Thus, this construction can prevent lowering of the heat-dissipation effect resulting from evaporation of the heat-dissipation layer itself under the influence of the heat generated in the target by collision of the electron beam.

Preferably, the heat-dissipation layer is formed of a material with a higher thermal conductivity than the target.

This construction can increase the amount of heat conduction compared with where the heat-dissipation layer is formed from the same material as the target. Consequently, since it is easy to reduce the localized temperature rise at the colliding point of the electron beam, the evaporation of the target near the electron beam irradiating position can be reduced.

Preferably, a protective film of high melting point covers the inner wall and edge regions of the opening in the heat-dissipation layer.

With this construction, compared with where the heat-dissipation layer touches a vacuum directly, the heat-dissipation layer covered with the protective film does not easily evaporate. Moreover, when the protective film is formed from a high melting point material, the amount of evaporation of the protective film can be further reduced. Hence evaporation of the heat-dissipation layer is reduced, and lowering of the heat-dissipation effect is reduced.

Preferably, the target surface touched a vacuum through a bore formed in the heat-dissipation layer is covered by a thin protective film formed from a high melting point material or electrons easily penetrable material.

With this construction, it is possible to prevent directly the target evaporation and reduce a temperature rise of the target surface.

The X-ray generating apparatus according to this invention may further comprise a detection device for a position of the opening, a positioning device for moving the target, and a controller for a detection device and a positioning device.

With this construction, since the controller performs a position adjustment for allowing the electron beam to irradiate the opening in the heat-dissipation layer, the electron beam collides the center of the opening. Therefore, no great mechanical accuracy is required in time of attaching the target to the X-ray tube. Moreover, since the electron beam irradiates the center of the opening, a uniform heat-dissipation effect, i.e. the greatest heat-dissipation effect, is obtained.

With a plurality of openings formed in the heat-dissipation layer, when one opening becomes unusable due to electron beam irradiation, the controller performs a position adjustment toward another opening. Thus, the target and X-ray tube can be used over a long time.

Preferably, the positioning device is a deflection device for deflecting a course of the electron beam.

This construction, compared with the case of positioning the target mechanically, the deflection device can easily move the electron beam colliding point on the target with high precision. Therefore, a uniform heat-dissipation effect, i.e. the greatest heat-dissipation effect, is obtained.

Preferably, the detection device includes, as part thereof, an electrical insulator layer containing in the target. Thus a current as a result of electron beam irradiation is easy to measure.

The X-ray generating apparatus according to this invention, preferably, includes an internal heat-dissipation layer in contact with the target reverse to the surface irradiated by the electron beam.

This construction allows the heat generated in the target to dissipate easily in the direction of the back surface also, thereby further promoting a lowering of the temperature on the target surface.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

FIG. 23 is a view showing calculation results of a heat-dissipation effect.

DESCRIPTION OF THE PREFERRED EMBODIMENTS

An embodiment of this invention will be described hereinafter with reference to the drawings.

Figure 1:
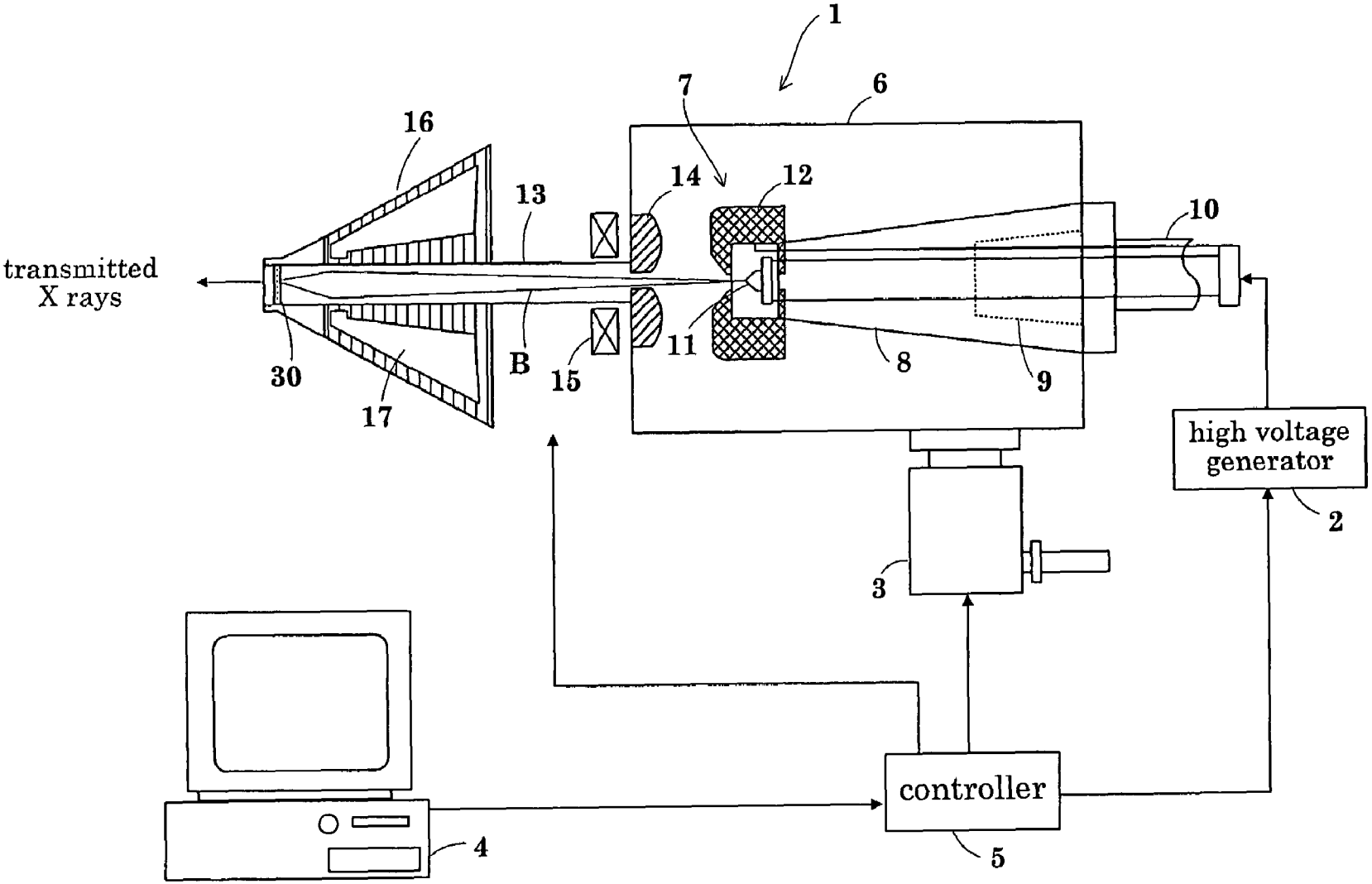
FIG. 1 is a section showing an outline of an X-ray generating apparatus.
Figure 2:
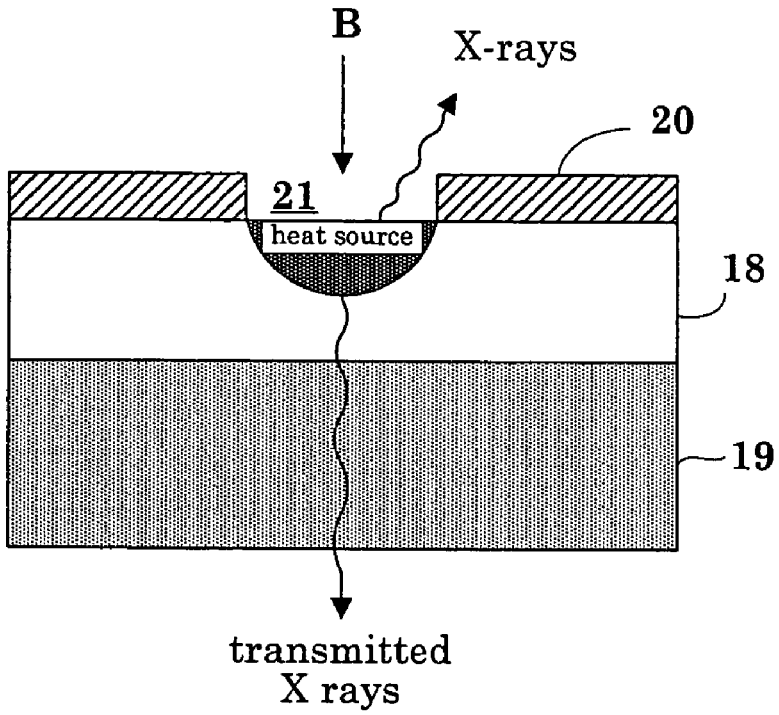
FIG. 2 is a section showing a principal portion for generating X-rays.

FIG. 1 shows an outline of an X-ray generating apparatus, with an X-ray tube 1 shown in section. FIG. 2 is a section showing a principal portion for generating X-rays.

The X-ray generating apparatus in this embodiment shown in FIG. 1 includes an X-ray tube 1, a high voltage generator 2, a vacuum pump 3 and a controller 5. Instructions given by the operator are transmitted through a computer 4 to the controller 5 to generate X-rays as desired.

The X-ray tube 1 shown in section in FIG. 1 is the type called an open X-ray tube because it can be opened anytime for cleaning and maintenance and is evacuated prior to each use by the vacuum pump 3 connected to the vacuum vessel 6. A negative high voltage generated by the high voltage generator 2 is transmitted through a high voltage cable 10 and plug 9 inserted into a high voltage socket 8, to be applied to a filament 11 and a grid 12 constituting an electron gun 7. The vacuum vessel 6 has a perforated anode 14 attached thereto and having a central bore for passage of electrons. The anode 14 is maintained at ground potential and acts as a positive electrode and accelerates electrons from a filament 11. A vacuum pipe 13 connected to the vacuum vessel 6 has a deflector 15 mounted peripherally thereof.

An electron lens, which combines a yoke 16 with a magnet coil 17, is disposed at a forward end of X-ray tube 1 for converging an electron beam B. A target 30 is mounted tight centrally of a forward end of the yoke 16 and sealed by an O-ring. The target 30 includes a target layer 18 on the vacuum.

Electrons emitted from the filament 11, while being adjusted by the grid 12, are accelerated by a potential difference of the perforated anode 14 to travel through the vacuum pipe 13. Then, the electrons are converged to a diameter in the order of 1 μm by the electron lens, which combines a yoke 16 with a magnet coil 17, and collide with the target layer 18 to generate X-rays of minute diameter. The deflector 15 can change directions of electron beam B, and adjust an electron beam irradiating position on the target 30.

FIG. 2 is a section showing a construction of an X-ray generating portion of the target 30. As shown in FIG. 2, the surface solid 20 is disposed in tight contact with the surface of the target layer 18 supported by a backing plate 19. The surface solid 20 that characterizes this invention is shown as defining an opening 21. The converged electron beam B collides with the surface of the target layer 18 through the opening 21, then X-rays and heat are generated. While the opening 21 shown is in the form of a bore extending through the surface solid 20, the invention is not limited to such a bore but may adopt numerous other forms.

The backing plate 19 shown in FIG. 2 functions mainly as a vacuum window and X-ray transmission window. Preferably, the backing plate 19 is capable of withstanding atmospheric pressure and transmitting X-rays efficiently. In many cases, aluminum or beryllium is used as its material. The thickness is about 0.1 to 1.0 mm. That is, a thin material is preferred for facilitating transmission of X-rays while withstanding atmospheric pressure. The backing plate 19 is maintained at ground potential, and serves as a dissipation path for the heat generated in the target.

The target layer 18 shown in FIG. 2 is made from a high melting point metal such as tungsten or molybdenum. A high melting point metal is often used as the target since it does not evaporate easily. Generally, it is preferable to select a thickness of the target layer 18 appropriately according to an accelerating voltage. The target layer 18 formed of tungsten, preferably, has a thickness in the order of 10 μm when the accelerating voltage is 100 kV, and 1 μm when the accelerating voltage is 30 kV. However, a somewhat large thickness is selected with a view to extending the life of the target, and a transmission X-ray tube tends to absorb a large amount of X-rays. In this connection, a reflection type X-ray tube often has a thickness of 1 mm or more since the reflection direction X-rays do not pass through reflection type target.

The surface solid 20 shown in FIG. 2 is disposed in tight contact with the surface of the target layer 18 irradiated by the electron beam B, and defines the opening 21 adjacent the location where the converged electron beam B impinges. In this embodiment, the electron beam converged to the diameter of 1 μm collides with the target, and thus the diameter of the opening 21 is set also to 1 μm. With this construction, the surface solid 20 does not block the course of electron beam B, and X-rays are generated from the target layer 18 as in the prior art. Moreover, even though heat is generated adjacent the target surface by the electron beam collision, the temperature of the location of electron beam collision is reduced by the heat conduction of the surface solid 20 as well as the heat conduction of the target layer 18 and the backing plate 19.

Figure 3:
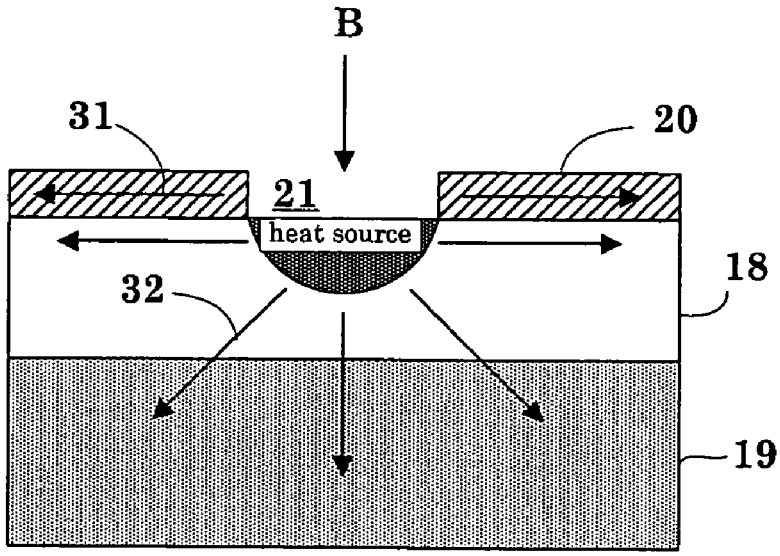
FIG. 3 is an explanatory view showing heat conduction on the surface of the target.

FIG. 3 shows, in detail, the way in which the heat is dissipated. When the converged electron beam B collides with the target 30, heat is generated adjacent the surface where the collision occurs. With the X-ray tube 1 shown in FIG. 1, the electron beam B in time of collision has the diameter as small as about 1 μm, which causes a local temperature rise. The surface of the target colliding with the electron beam B undergoes a momentary temperature rise. The heat generated locally radiates as indicated by arrows 31 and 32.

In the case of a conventional target without the surface solid 20, the generated heat could radiate as indicated by arrows 32 only toward the backing plate 19 through the target layer 18. However, according to this invention, the surface solid 20 in tight contact with the target layer 18 also serves as a heat-dissipation path as indicated by arrows 31 radially of the electron beam B. The surface solid 20 constitutes an increase in the volume of heat conduction. A temperature rise is proportional to the inflow quantity of heat per volume. In this invention, a temperature rise reduces, because heat value is the same but the volume of heat conduction increases. That is, it is easy to radiate heat and produce the effect of lowering temperature. Since this invention provides the heat-dissipation layer on the surface, it is particularly effective to reduce the temperature rise on the target surface that undergoes a remarkable temperature rise. It will be clear that the thicker the surface solid 20 is, the larger becomes the volume of heat conduction to promote the heat-dissipation effect.

The surface solid 20 is disposed adjacent the location of electron beam collision, and close to hot areas. Since the larger temperature difference results in the higher heat flow rate, the closer the surface solid 20 is to the location of electron beam collision, the higher becomes the heat flow rate to reduce the temperature rise adjacent the location of electron beam collision. That is, it is easy to radiate heat and produce the effect of lowering temperature. Since this invention provides the heat-dissipation layer on the target surface, it is particularly effective to reduce the temperature rise on the target surface that undergoes a remarkable temperature rise. It will be clear that the closer the surface solid 20 is to the location of electron beam collision, the greater becomes the heat-dissipation effect.

As described above, the surface solid 20 reduces the temperature rise of the target layer, so reduces evaporation of the target material, then extends the target life. Further, the target can also be reduced to a minimum thickness to increase the amount of transmission X-rays.

The surface solid 20, preferably, is formed of a material having high thermal conductivity [W/mK], for example. High thermal conductivity provides a high heat flow rate per unit volume to increase the amount of heat-dissipation which further lowers the temperature of the location of electron collision on the target. Specific examples of such material include metals such as copper, silver, gold and aluminum, carbons such as diamond, DLC film, PGS and SiC, boron compounds and alumina ceramics. A particulate material may be used also.

A material of high melting point is also desirable as the material for the surface solid 20. Since a material of high melting point has a low evaporation rate even at high temperature to reduce the amount of evaporation of the surface solid itself, the heat-dissipation effect is maintained over a long period of time. The high melting point material, preferably, is a carbon material, for example, where the target is formed of tungsten, and tungsten, rhenium or tantalum where the target is formed of molybdenum. Thus, it is preferable to design the surface solid 20 by considering thermal conductivity and melting point temperature of materials according to the purpose for which the X-ray tube is intended. However, it is also possible to use the same material for the target and the surface solid 20. It is one of the simplest constructions according to this invention to provide the surface solid 20 formed of tungsten for the target formed of tungsten.

Next, a manufacturing method for forming the surface solid 20 on the target surface will be described.

In the simplest manufacturing method, a perforated metal plate is bonded to the target surface. However, a manufacturing process for forming a highly precise opening as in this embodiment, preferably, is realized by a combination of a film forming method and a method of shaping the opening. Therefore, the diameter of the electron beam that collides with the target determines the shaping accuracy required and put limitations on the manufacturing method. Where, as in this embodiment, the collision diameter of the electron beam is set to about 1 μm, it is optimal to use IC manufacturing technology for forming the surface solid 20 as set forth in claims 3 through 5.

The film forming methods suited to this invention include PVD (vacuum deposition, ion plating, various sputtering methods), CVD and plating method. Among these, PVD and CVD have a wide range of use and are effective since these methods can form a film from almost all solid materials such as ceramics and metals including the target material. For example, after forming the target layer, the process may be continued to form the surface solid 20 in a vacuum. Thus, the target and the surface solid 20 may be formed as films in tight contact with each other. In the plating method, materials that can be formed as a film are limited, but its process is simple since the film is formed not in a vacuum but in a solution. Moreover, it is easy to form a thick film about several microns, and therefore the plating method is suited, inexpensive film forming method where gold, silver, copper, nickel or chromium is used as the material for the surface solid 20.

As an opening shaping method suitable for this invention, the lithographic method which is IC manufacturing technology is highly accurate and best suited. The lithographic method is a complicated method for micro fabrication through a procedure including photoresist coating, exposure, development, pattern etching and photoresist removal performed in the stated order. This method is effective for forming the opening 1 μm in diameter as in this embodiment. However, an opening several to several tens of micrometers in diameter can be formed also by a method using a deposition mask, plating mask or the like. Such methods are useful in that the procedure involves few steps and is inexpensive. Each of these methods uses a mask, and will be referred to hereinafter simply as "masking method".

Next, a specific example of manufacturing process combining a film forming method and a masking method will be described.

The film forming method is used to form the surface solid 20 on the target layer 18 formed on the surface of the backing plate 19. Next, the masking method is used to form an opening. In an example of the masking method, a resist is first applied to expose an opening pattern. Next, the resist corresponding to the opening is removed, an opening portion of the surface solid 20 is removed by etching, to form the opening (bore 21). Finally, the remaining resist is removed such as by ashing to obtain the product according to this invention. When providing a multilayer structure or a protective film on the surface solid 20 as described hereinafter, steps similar to the above may be repeated.

For forming an opening several to several tens of micrometers in diameter in the surface solid 20, a method as set forth in claim 4 is also suitable. While the film forming method is the same as that described above, the opening shaping method uses precision machining (electric discharge machining, laser beam machining, electron beam machining or the like). Precision machining is suited since it does not use a mask, or a vacuum or plating solution, and since it offers a freedom for processing size and can easily form an opening even in a thick film.

Where the X-ray generating apparatus uses an electron beam having a diameter of 0.1 mm or larger, the surface solid 20 having a bore may be formed by a different method. For example, the surface solid 20 may be formed by applying a spray or adhesive containing carbon particles or metal particles. The method of manufacturing the X-ray generating apparatus according to this invention is not limited to those described above.

The X-ray generating apparatus set forth in claim 5 can be manufactured in the simplest way. This manufacturing method uses the same film forming method as in the above manufacturing method, but the opening forming method is different.

Figure 4:
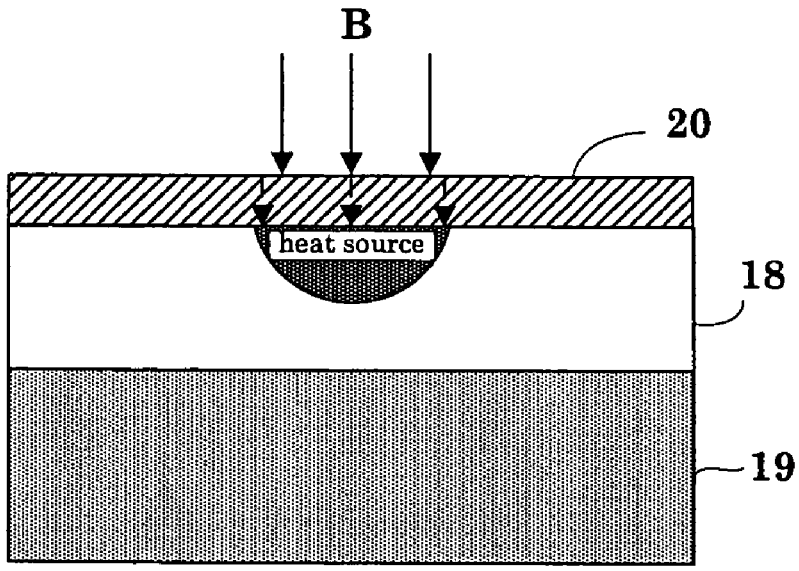
FIG. 4 is an explanatory view showing formation of a bore.
Figure 5:
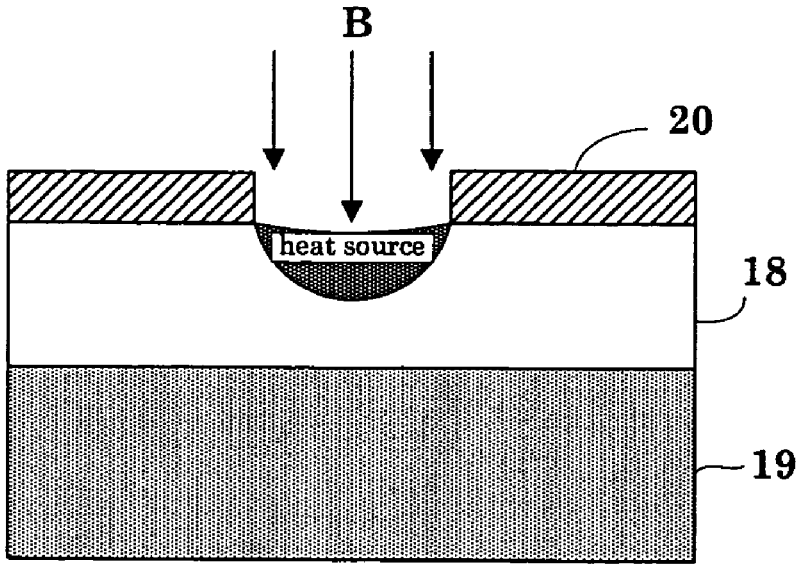
FIG. 5 is an explanatory view showing formation of the bore.

The first step is a step of forming the surface solid 20 as a film on the surface of target layer 18 on the backing plate 19. As shown in FIG. 4, a heat-dissipation layer without an opening is formed. In the second step, the target is attached to the X-ray tube. In the last step, the opening 21 is formed by irradiating the surface solid 20 with an electron beam B emitted from the electron gun of the X-ray tube. As shown in FIG. 5, the electron beam collides to evaporate a portion of the surface solid 20 until the opening reaches the surface of target layer 18 to become the opening 21. This process utilizes a local evaporation resulting from a local temperature rise due to the irradiation by the electron beam of small diameter. It is realistic to determine irradiating conditions of the electron beam empirically from the material and thickness of the target and surface solid.

Further, it is preferable to emit an electron beam of about 1 msec or less in a pulse train since this is more effective to cause a localized temperature rise than a continuous irradiation, thereby forming an opening closely corresponding to the collision diameter of the electron beam. However, where the surface solid 20 is formed of a material that does not evaporate easily, a larger current may be required than when generating X-rays. Then, what is necessary is just to use an electron gun of large current output. In other words, it is preferred that the surface solid 20 is formed of a material relatively easy to evaporate, such as copper, gold or silver.

When the opening 21 is formed in the surface solid 20 by using the above steps, there is no need to make a positional adjustment, after attaching the target 30 to the X-ray tube, for the electron beam B to collide with the formed opening 21. This is ideal and simplifies the manufacturing process according to this invention.

Next, the relationship between the shape and material of the surface solid 20 and temperature rise will be described using examples of trial calculation.

When a simplification is made by regarding the target as a semi-infinite object, and the electron beam is regarded as a heat source uniformly irradiating a circle of radius "a" on the surface of the semi-infinite object, a temperature rise tsem (k) in a position on the surface of the semi-infinite object at a distance k times the radius "a" from the center of the heat source is derived from the following equation (1):

$$t_{sem}(k) = \frac{Q_{sem}}{2\pi a \lambda_{sem}} \int_0^{\infty} J_0(k \cdot \xi) J_1(\xi) \cdot \frac{1}{\xi} d\xi \tag{1}$$

Figure 22:
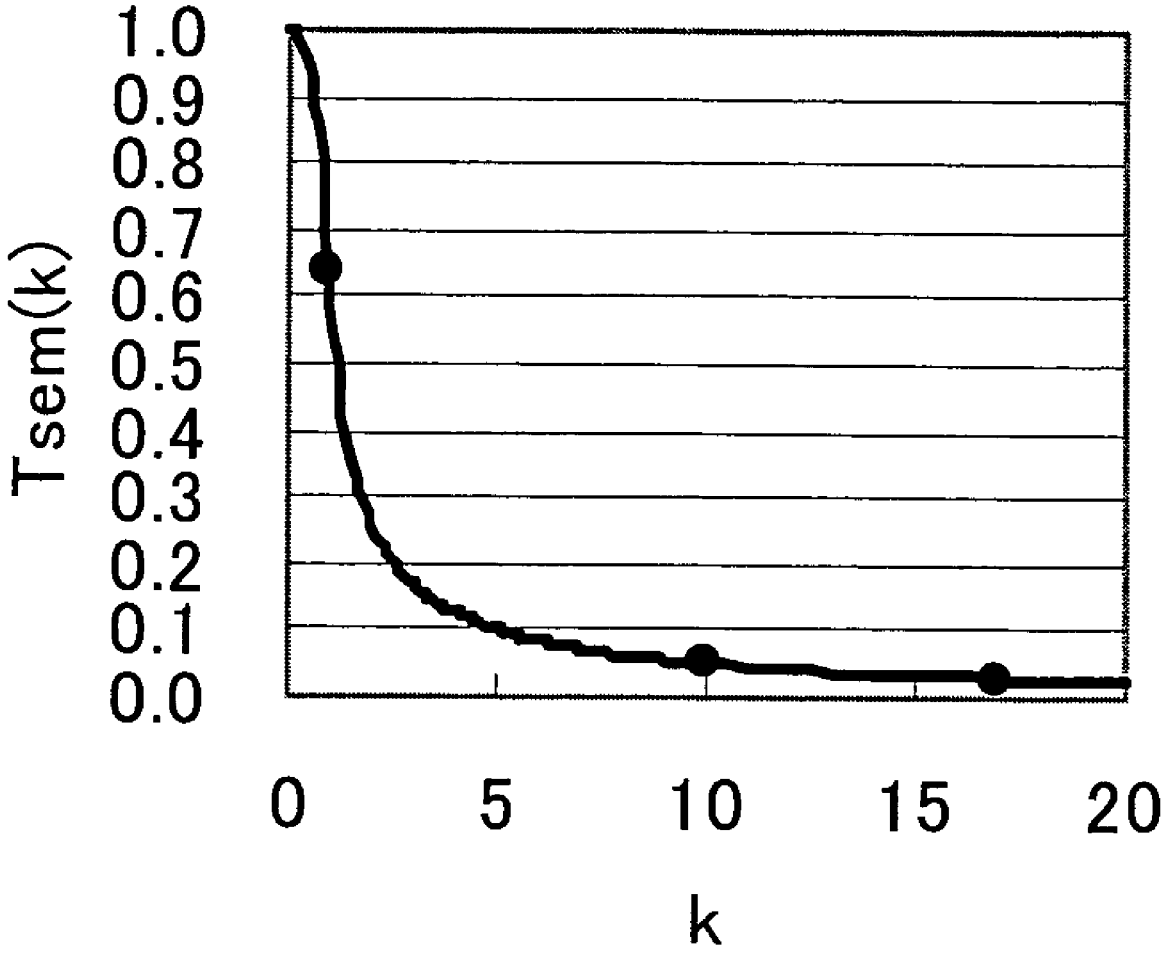
FIG. 22 is a view showing a distribution of surface temperatures.

The above equation is a formula in which the material constant of the semi-infinite object is not dependent on temperature, its thermal conductivity λsem [W/m·K] is fixed, and its surface in a circle of radius a[m] is heated uniformly at Q[W] (=[J/sec]) by the electron beam, with no thermal radiation. Further, J0 and J1 are Bessel functions of the first kind in the zero order and first order, and the integration term of equation (1) is calculable once k is determined, which is expressed as Tsem (k). Tsem (k) describes a curve as shown in FIG. 22, which represents a surface temperature rise normalized with a maximum temperature rise regarded as 1. Since the inside of the heat source (k≦1) generates heat uniformly, maximum Tsem(0)=1 at the heat source center (k=0).

In the outside of the heat source (k>1), heat is conducted hemispherically from the heat source center. It will be seen that, with an increase of k, temperature changes diminish abruptly. Calculations show a temperature rise of only 5% of the maximum temperature at k=10, and a temperature rise of only 2.9% of the maximum temperature at k=17.

Figure 6:
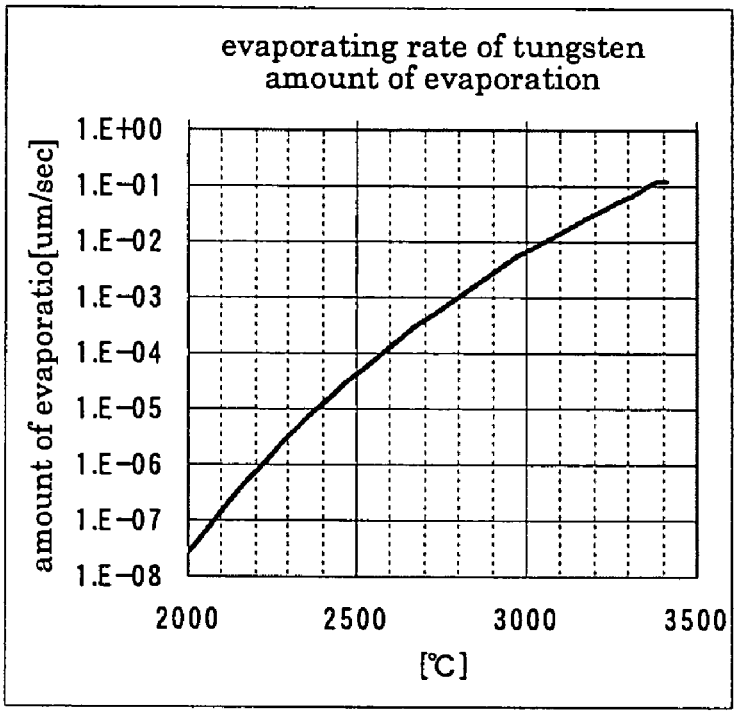
FIG. 6 is a view showing temperature and evaporation of tungsten.

FIG. 6 shows amounts of evaporation of tungsten which is the material most commonly used as target. The heat value at 2,500° C. is only $5.8\times10^{-5}$ μm/sec (=0.21 μm/hour), but the heat value at the melting point (3,410° C.) becomes as high as 0.12 μm/sec. Thus, the amount of evaporation increases exponentially toward the melting point temperature (3,410° C.). The amount of evaporation is ½,000 in the range of 910° C. between the two temperatures, which is converted to a decrease of ½.3 in the amount of evaporation with each temperature decrease of 100° C.

That is, when the target 30 is used at the melting point temperature, the life is extended advantageously by 2.3 times by lowering the temperature at the target center by 100° C. by action of the surface solid 20. The 100° C. difference corresponds to 2.9% of the melting point temperature. From the temperature calculation results of the semi-infinite object, it is understood that the surface solid 20 formed of tungsten must be in tight contact with a portion at least within 17 times the heat source radius.

Next, examples of trial calculation of the heat dissipating effect of the surface solid will be described. Where, as the simplest form, the surface solid is a hollow disk having a bore formed in a disk, a heat conduction formula of the disk can be used.

Figure 7:
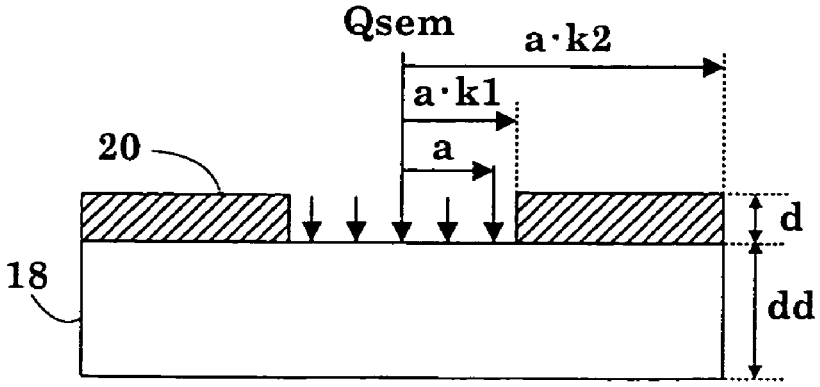
FIG. 7 is an explanatory view of a trial calculation of a the heat-conduction of a surface solid.

As shown in FIG. 7, the disk has an inside diameter k1 times the heat source radius "a", an outside diameter k2 times the heat source radius "a", and a thickness d. Thermal conductivity λdisk [W/cm·k] is fixed and not temperature-dependent. Assuming that the quantity of heat Qdisk [W] (=J/sec) is conducted from the inner surface to the outer surface of the disk without thermal radiation, the relationship between the temperature td (k1) of the inner surface [° C.] and the temperature td (k2) of the outer surface [° C.] is expressed by the following equation (2):

$$t_d(k_1) - t_d(k_2) = \frac{Q_{disk}}{2\pi \cdot d \cdot \lambda_{disk}} \mathrm{Log}\left(\frac{k_2}{k_1}\right) \tag{2}$$

With the surface solid of hollow disk form disposed on the target surface, when the temperature difference {td(k1)−td (k2)} between the inner and outer surfaces of the disk is smaller than the temperature difference {tsem(k1)−tsem (k2)} between the surfaces of the semi-infinite object at k1 and k2, the hollow disk may be said to have a greater effect of reducing surface temperature than the semi-infinite object. Then, based on equation (1) and equation (2), the ratio between these temperature differences is expressed by the following equation (3):

$$\frac{t_d(k_1) - t_d(k_2)}{t_{sem}(k_1) - t_{sem}(k_2)} = \frac{Q_{disk}}{Q_{sem}} \cdot \frac{\lambda_{sem}}{\lambda_{disk}} \cdot \frac{d}{a} \cdot \frac{\mathrm{Log}\left(\frac{k_2}{k_1}\right)}{T_{sem}(k_1) - T_{sem}(k_2)} \tag{3}$$

When the value of this equation (3) smaller than 1, it is a fact that the heat-dissipation disk has a higher capability reducing surface temperature than the semi-infinite object. At the same time, a trial calculation can be made of the heat-dissipation effect of the heat-dissipation disk. However, it is also assumed that an inflow and outflow of heat to/from the heat-dissipation disk take place at an inner/outer surface, and there is no heat conduction at the contact surfaces of the heat-dissipation disk and semi-infinite object, this equation (3) is considered to give the worst value of the effect of this invention. Further, since Qsem is a total amount of heat input, the first term on the left side of equation (3) becomes 1 or less but is difficult to determine accurately. The dissipating effect with the worst value 1 will be described with comparisons.

First, the second term on the left side of equation (3) is a ratio of thermal conductivity. It shows that, when the heat-dissipation disk has the higher thermal conductivity than the semi-infinite object, the heat dissipating effect is the greater.

Next, the third term on the left side of equation (3) shows that, when the heat-dissipation disk is thicker in relation to the heat source radius, the heat dissipating effect is the greater.

The fourth term on the left side of equation (3) is determined by the inside diameter and outside diameter of the heat-dissipation disk. It shows that, when the fourth term value is smaller, the heat-dissipation effect is greater.

FIG. 23 shows numerical values of the fourth term actually calculated in the range of k1<k2.

It will be seen from FIG. 23 that the heat-dissipation disk of k1=1 and k2=2 has the greatest heat-dissipation effect. Similarly, a portion close to the heat source is preferable for the greatest heat-dissipation effect. Further, it will be seen that an increase of k2 for each value of k1 lowers the heat-dissipation effect.

Two examples will be described as special cases where a total heat input passes through the heat-dissipation disk and the heat-dissipation disk is formed from the same material of a target.

First, equation (3) and FIG. 23 show that the heat-dissipation disk contacting the heat source at k=1 produces a heat-dissipation effect at least corresponding to that of the semi-infinite object when "1.8<d/a" is established, that is when thickness d of the heat-dissipation disk equals with or exceeds the diameter of the electron beam. This serves as the standard of thickness of the heat-dissipation solid.

The worst value 18.9 in the table shown in FIG. 23 occurs when k1=9 and k2=10. Even in this case, the heat-dissipation effect comparable to that of the semi-infinite object will be secured by increasing thickness d to be 18.9 times the electron beam radius. That is, even thickness d corresponding to the electron beam radius has the effect of lowering temperature by $1/18.9$=5.2%. A heat-dissipation disk not exceeding 10 times the heat source radius may be said to have a sufficient effect.

Next, examples of the surface solid 20 acting as the heat-dissipation layer will be described. Parts identical to those of the foregoing embodiment are shown with the same reference numbers, and only different parts will be described particularly.

EXAMPLE 1

Figure 8:
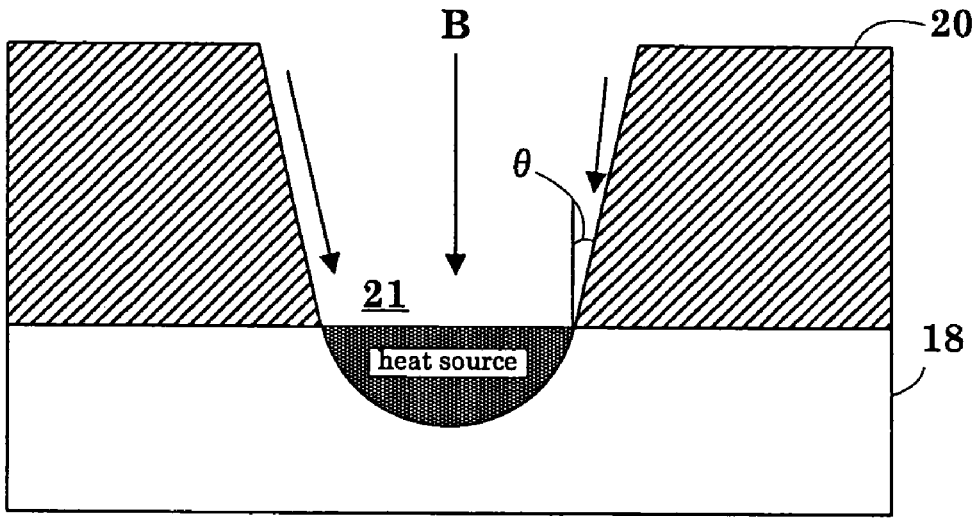
FIG. 8 is a section showing a principal portion around a target of example 1.

The example shown in FIG. 8 corresponds to claim 8, and the shape of bore 21 differs from the foregoing embodiment. Specifically, the bore 21 has a tapered shape with the inner wall surface converging from the electron beam incoming side toward the target layer 18. That is, the inner wall surface of the bore 21 is tapered to correspond to the shape of electron beam B with the forward end converged in the direction of movement by a lens. The taper has an angle θ which, preferably, is several to 60 degrees, for example, although this depends on the level of convergence of the electron beam B.

This construction can guide the tapered electron beam B to the target layer 18 without obstructing movement of the electron beam B. In addition, the portion of the surface solid 20 in tight contact with the target layer 18 can be located near where the electron beam B collides with the target surface. Consequently, the temperature of the heated portion on the target surface is lowered quickly by distributing the heat from that portion through the surface solid 20.

The tapered inner wall surface of the opening 21 may form a smooth slope, or may be stepped to become narrower in stages from the surface of the surface solid toward the surface of the target layer 18.

EXAMPLE 2

Figure 9:
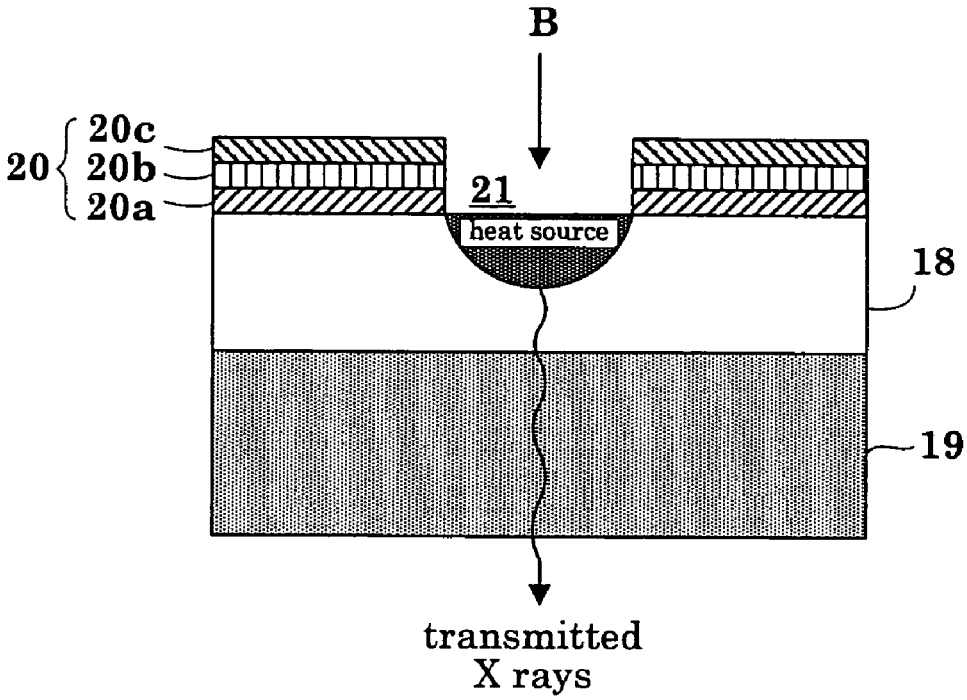
FIG. 9 is a section showing a principal portion around a target of example 2.

The example shown in FIG. 9 corresponds to claim 9, in which surface solids 20*a*-20*c* are formed in multiple layers on the target surface. The multilayer structure is formed by repeating a film forming process to change materials. For example, the lowermost layer 20*a* contacts tight with the target layer 18 and is formed from a highly heat-conductive material such as copper or silver. The next, intermediate layer 20*b* is formed from gold that is highly heat conductive and evaporates in a relatively small amount. The finally, uppermost layer 20*c* is formed from tungsten or molybdenum which is a high melting point and evaporates in a very small amount.

With this construction, the intermediate layer 20*b* and uppermost layer 20*c* prevent evaporation of the lowermost layer 20*a* while maintaining the heat-dissipation effect of the lowermost layer 20*a*. This construction reduces evaporating and so thinning of the surface solid 20 by target heat caused by electron beam irradiation, and maintains the heat-dissipation effect of the surface solid 20 for a long period of time. Thus, the X-ray generating apparatus can be used over a long period of time.

While this example has a three-layer structure, a similar effect is produced by a two-layer structure combining copper and tungsten, or copper and gold. Thin adhesive layers may be interposed between the illustrated layers to form a multilayer structure. Alloys can also be used instead.

EXAMPLE 3

Figure 10:
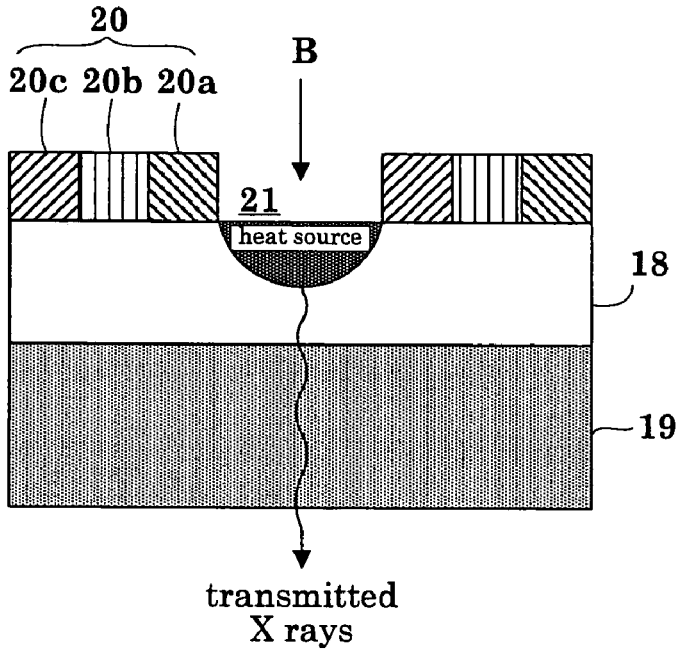
FIG. 10 is a section showing a principal portion around a target of example 3.

The example shown in FIG. 10 corresponds to claim 10, in which surface solids 20*a*-20*c* are formed in multiple layers on the target surface. The multilayer structure is arranged adjacent radially of the electron beam. It is preferred in this case that the layer 20*a* near the electron beam is formed from a high melting point material, and the outer layers 20*b*,20*c* are formed from a highly heat-conductive material.

With this construction, the layer 20*a* is the highest temperature among layers but evaporation is suppressed by its material nature and by the heat-dissipation of the layer 20*b,c*. Thus, the X-ray generating apparatus can be used over a long period of time.

EXAMPLE 4

Figure 11:
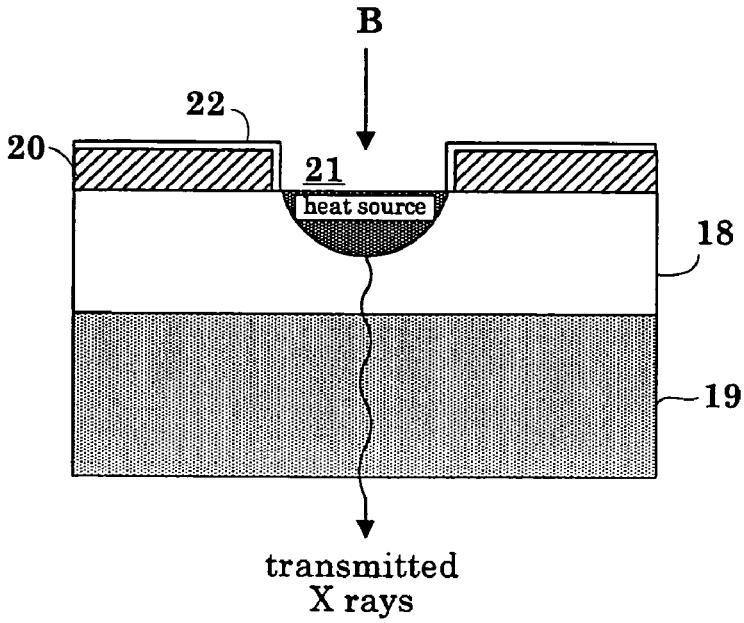
FIG. 11 is a section showing a principal portion around a target of example 4.

The example shown in FIG. 11 corresponds to claim 13, the heat-dissipation solid is covered by a protective film 22. Specifically, the edge regions and inner wall of the bore 21 are covered by the protective film 22. The thickness of the protective film 22 is set to a range of 0.1 to 1.0 μm.

Preferably, the protective film 22 is formed from a high melting point material such as tungsten. It is still more desirable to use a higher melting point material than the material of the surface solid 20 although this depends on operating conditions of the X-ray tube. For example, when the surface solid 20 is formed from tungsten, material preferred for the protective film 22 is selected from graphite, diamond, and carbides such as TaC, HfC, NbC, $Ta_2C$ and ZrC. When the surface solid 20 is formed from molybdenum, material preferred for the protective film 22 is selected from, besides the above-noted materials, tungsten, carbides such as TiC, SiC and WC, nitrides such as HfN, TaN and BN, and borides such as $HfB_2$ and $TaB_2$. Further, where the surface solid 20 is formed from copper, material preferred for the protective film 22 is selected from, besides the above-noted materials, high melting point metals and oxides. The high melting point metals are W, Mo and Ta, for example. The oxides are $ThO_2$, BeO, $Al_2O_3$, MgO and $SiO_2$.

The above construction can forcibly suppress evaporation of the surface solid 20 caused by heat. Consequently, the heat-dissipation effect is maintained over a long period of time, to extend the life of the target layer 18 also.

Figure 12:
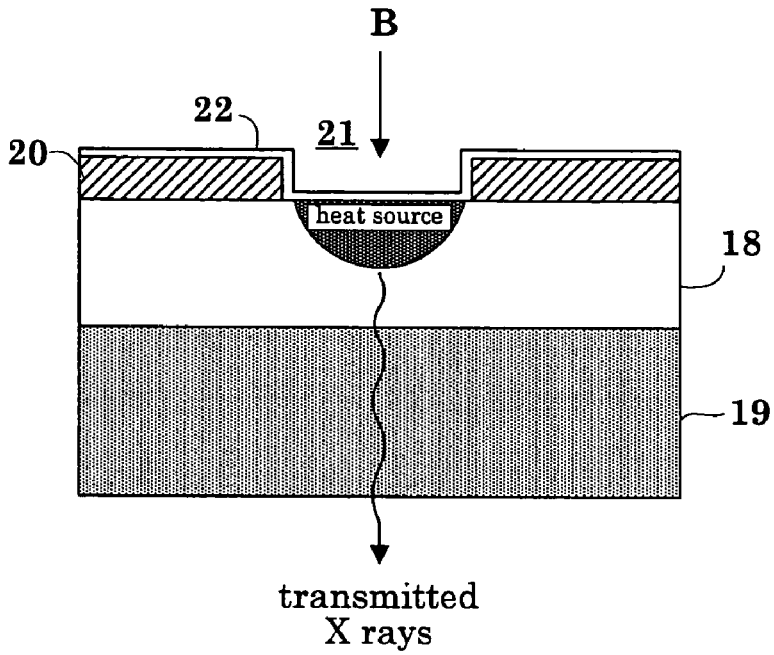
FIG. 12 is a section showing a principal portion around a target which is a modification of example 4.

The example shown in FIG. 12 corresponds to claim 14, in which the target surface exposed through the bore 21 for colliding with the electron beam B also is covered by the protective film 22.

Compared with the construction shown in FIG. 11, this construction can omit a work of removing the protective film 22 from the electron beam colliding portion. Since the protective film 22 is thin and so a major part of the electron beam B can penetrate the protective film 22 with little loss of energy, X-rays are generated.

When the electron beam current is relatively small and so causes only a minor temperature rise, the protective film 22 does not evaporate particularly. Thus, the protective film 22 can to some extent contribute to lowering of the surface temperature of the target layer 18. The protective film 22 can also forcibly suppress evaporation of the target layer 18 caused by heat.

However, when the electron beam B of large current continues to collide, the protective film 22 on the electron colliding portion will evaporate and change to the same form as FIG. 11 which has no protective film 22 on the target surface. This presents no problem since X-rays are generated as in the construction shown in FIG. 11.

A standard thinness of the protective film 22 shown in FIG. 12 will now be estimated and supplemented. Maximum electron penetration depth Dmax [μm] is expressed by the following equation (4):

$$D\max=0.021V^2/\rho \quad (4)$$

where V[kV] is an electron accelerating voltage and ρ[g/$cm^3$] is the density of the material.

Based on the above equation, a thinness of 1% or less of the value of Dmax may be the standard. For example, in the case of a thickness of 1% and 60 kV accelerating voltage for tungsten (density: 19.3 g/$cm^3$), Dmax=3.9 μm, and therefore the thickness of the protective film on the tungsten surface is set to about 0.04 μm. In the case of 60 kV accelerating voltage for titanium (density: 4.54 g/$cm^3$), Dmax=16.7 μm, and therefore the thickness of the protective film on the titanium surface is set to about 0.2 μm. In the case of 60 kV accelerating voltage for lithium (density: 0.53 g/$cm^3$), Dmax=143 μm, and therefore the thickness of the thickness of the protective film on the lithium surface may be about 2 μm. The compounds illustrated with reference to FIG. 11 may be used as the material, and calculations may be made in a similar way.

As may be inferred from the expression (4) of maximum electron penetration depth Dmax [μm], electrons are similarly diffused in transverse directions of the target also. Therefore, the collision radius of the electron beam is stated as a heat source radius in claim 6. It is to be noted, however, that, in practice, it is useful for determination of a form of the surface solid layer with increased accuracy to regard, as the heat source radius, a length having an electron dispersion radius added to the collision radius of the electron beam. That is, where the target material is tungsten and the accelerating voltage is 60 kV, Dmax=3.9 μm is calculated and the heat source radius is considered 1.95 μm even if the electron beam collision radius is 1 nm. It will be appreciated that the heat-dissipation disk in the form of surface solid 20 including the surface protective film 22 within 3.9 μm has a very effective heat-dissipation effect. This example gives a supplementary explanation of claim 6.

EXAMPLE 5

Figure 13:
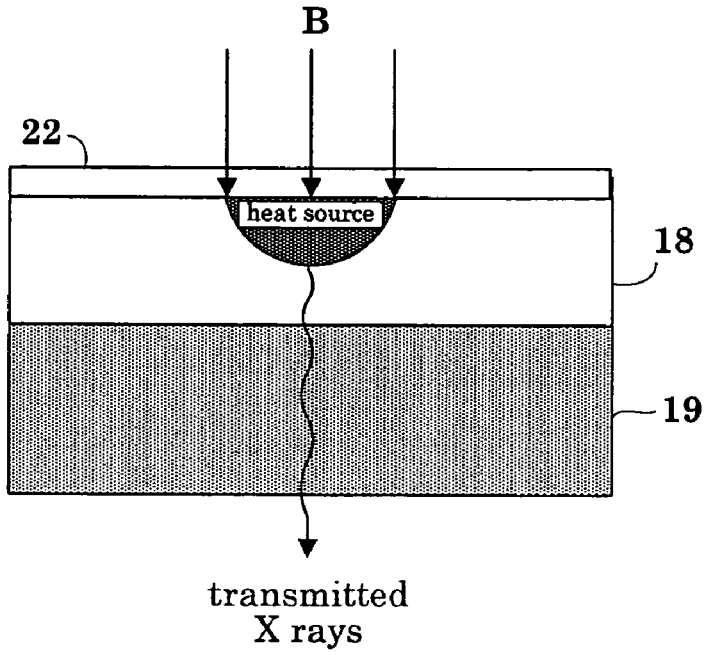
FIG. 13 is a section showing a principal portion around a target of example 5.

The example shown in FIG. 13 has the entire surface of the target layer 18 covered by a thin protective film 22. The protective film 22 is formed thinly from a material more easily penetrable by electrons than the material of the target layer 18, and requires a thickness setting. The thickness of the protective film 22 may be set to under the maximum electron penetration depth such as in the construction shown in FIG. 4. However the thin protective film 22 is easily evaporate, because a material easily penetrable by electrons has a low melting point also. Therefore, it is effective that the X-ray tube is operated with low electric power for a long time.

Specific examples of the material for the protective film 22 are metals with density in a range of 8.9 to 0.58 g/cm$^3$, such as Ni and Li. In particular, titanium of the density 0.58 g/cm$^3$ is preferred. Also suited are materials easily penetrable by electrons and highly heat conductive. Such materials have large values of ((1/density)×thermal conductivity), e.g. Be, Mg, Al, Si, C, Cu and Ag.

With this construction, electrons can penetrate the protective film 22 with little loss of energy, to reach the target layer 18 and generate X-rays. The protective film 22 can reduce the surface temperature of the target layer 18, and also suppress evaporation of the target layer 18 due to heat.

Further, when the electron beam B continues tocollide a long time, the protective film 22 on the electron colliding portion will evaporate, and change to the form having no protective film 22 on the target surface. This presents no problem.

EXAMPLE 6

Figure 14:
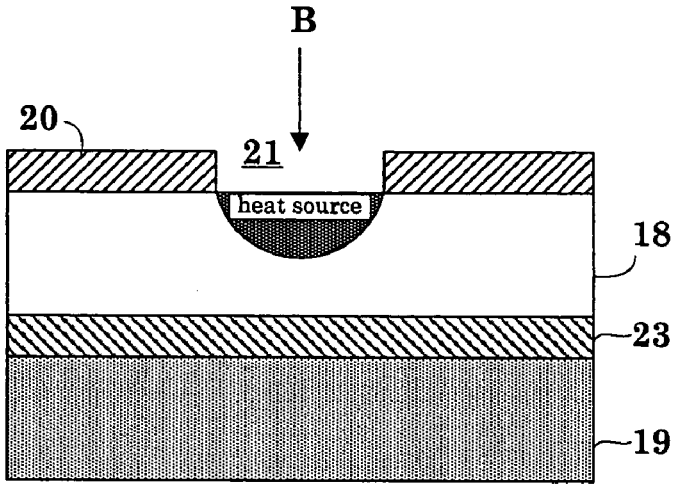
FIG. 14 is a section showing a principal portion around a target of example 6.

The example shown in FIG. 14 corresponds to claim 18, in which an internal heat-dissipation layer 23 with a thickness of 1 to 10 μm is formed in tight contact with the reverse of target layer 18 in addition to heat-dissipation layer 20. Preferably, the internal heat-dissipating layer 23 is formed from a material (gold, silver, copper or aluminum) of higher heat conductivity than the target layer 18. Since this internal heat-dissipation layer 23 is present between the target layer 18 and backing plate 19, evaporation of its material by heat is prevented even if the material has a lower melting point than the material of the target layer 18.

In addition to the heat conduction by the surface solid 20, this construction is capable of an efficient three-dimensional heat-dissipation through the heat conduction occurring in the direction of target thickness. Thus, the surface temperature of the target layer 18 can be reduced more efficiently and so an evaporation of the target layer 18 can be suppressed more.

Inventor herein has simulated the temperatures of the target shown in FIG. 14 and of a conventional target. In the simulation, the conventional target is formed of 3 μm thick tungsten layer with the 100 μm thick aluminum backing. In addition to the conventional target as noted above, the target of this invention includes the surface solid 20 and internal heat-dissipation layer. The surface solid 20 is formed from copper of thickness d=1 μm, and the opening is formed of radius r1=a (k1=1) and radial distance r2=∞ from the center of the opening (center of the electron beam). The internal heat-dissipation layer 23 formed of 1 μm thick copper is provided on the back surface of the target. As other simulation conditions is mentioned below. A thermal conductivity is not dependent on temperature. The thermal conductivities of tungsten, aluminum and copper are fixed to 90, 200 and 342 W/mk. The electron beam B collides with the target in a radius of 0.5 μm. A heat of 0.5 W is generated on the collision surface with a diameter of 1 μm. The backing plate 19 is maintained at 100° C. And then the simulations of temperatures of the targets have been carried out by the finite element method under the above conditions.

Figure 15:
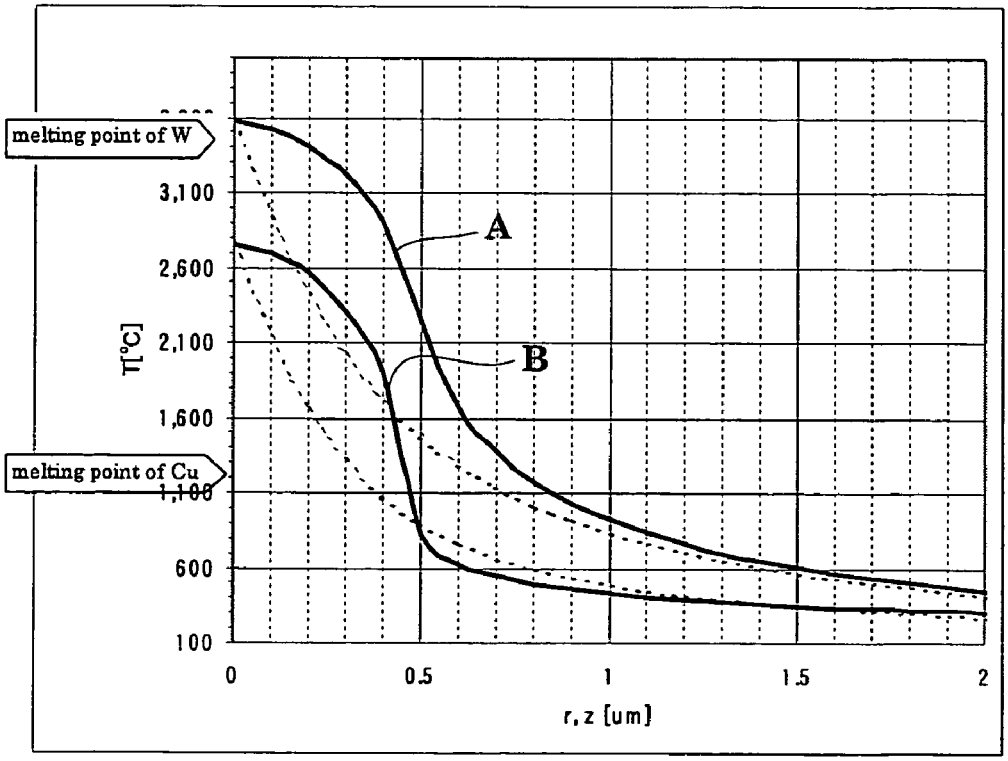
FIG. 15 is a view showing a temperature change simulation of the target of example 6 and a conventional target.

The results are shown in FIG. 15. The horizontal axis represents the distance from the electron beam irradiation center regarded as 0 to the target layer 18. The vertical axis represents the temperature of the target layer 18. The solid line A indicates the surface temperature of the conventional target. The solid line B indicates the surface temperature of the target of this invention. The simulation result in FIG. 15 shows remarkable improvements; the target surface temperature decreases about 1,000° C. within the 0.5 μm radius, and also the highest temperature decreases about 860° C. The highest temperature is at the central point on the target surface irradiated by the electron beam, and then the simulation result is 3,570° C. of the conventional target and 2,710° C. of this invention. That is, this invention causes the maximum temperature to decrease 24% in spite of the same heat 0.5 W. Thus, it has been confirmed that it is most effective to form the heat-dissipation layers on the front and back surfaces of the target.

Next, an example corresponding to claim 15 will be described. In order to carry out a position adjustment for allowing the electron beam B to pass through the opening 21 described in each of the above examples, it is necessary to control, in combination, a detection device and a positioning device. The positioning device is a device for moving the target or deflecting the electron beam. The controller scans to detect the position of the opening with the detection device and the positioning device which is used to move the position of the electron beam colliding with the target. After the scanning operation, the control performs to move the electron beam B to a specified position so that the electron beam B passes through the opening 21.

As an example of the detection device, an electronic detection device used in an SEM (scanning electron microscope) is applicable. Specifically, the detection device includes an ammeter capable of measuring backscattered electrons, secondary electrons or absorption current. Backscattered electrons, secondary electrons and absorption current differ in amount from one another according to the material and shape of the object with which electrons collide. Thus, the position of the surface solid 20 or the target layer 18 can be determined by measuring and comparing the amount of either one of the currents.

Figure 17:
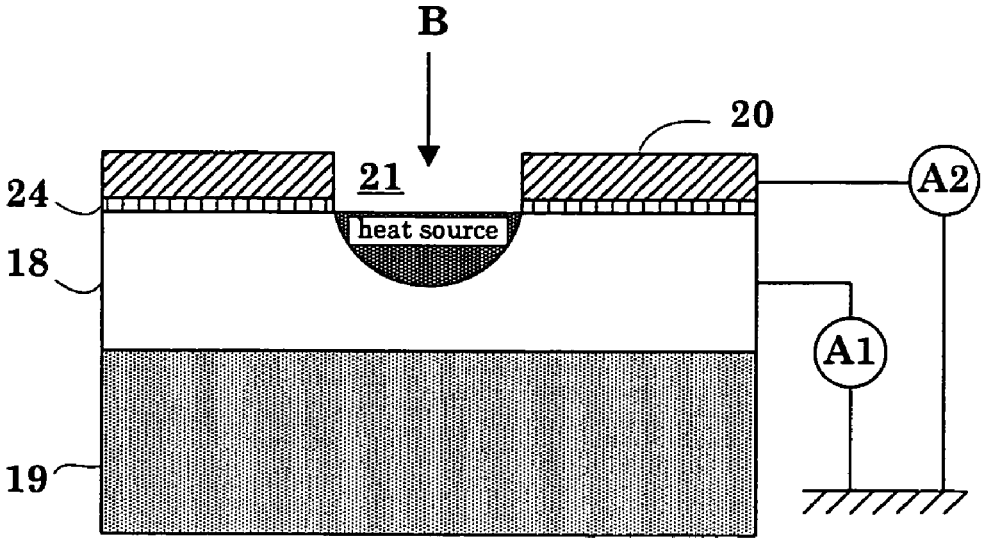
FIG. 17 is a schematic view showing the position adjustment of the electron beam.

The detection device shown in FIG. 17 corresponds to claim 17, wherein the target includes a thin insulator layer 24 formed between the target layer 18 and surface solid 20. The insulator layer 24 facilitates detection of currents flowing to the target layer 18 or the surface solid 20. Since it is unnecessary to form a special detector in the X-ray tube, this construction provides the smallest detection device.

The positioning device may be an electron beam-moving device.

Figure 16:
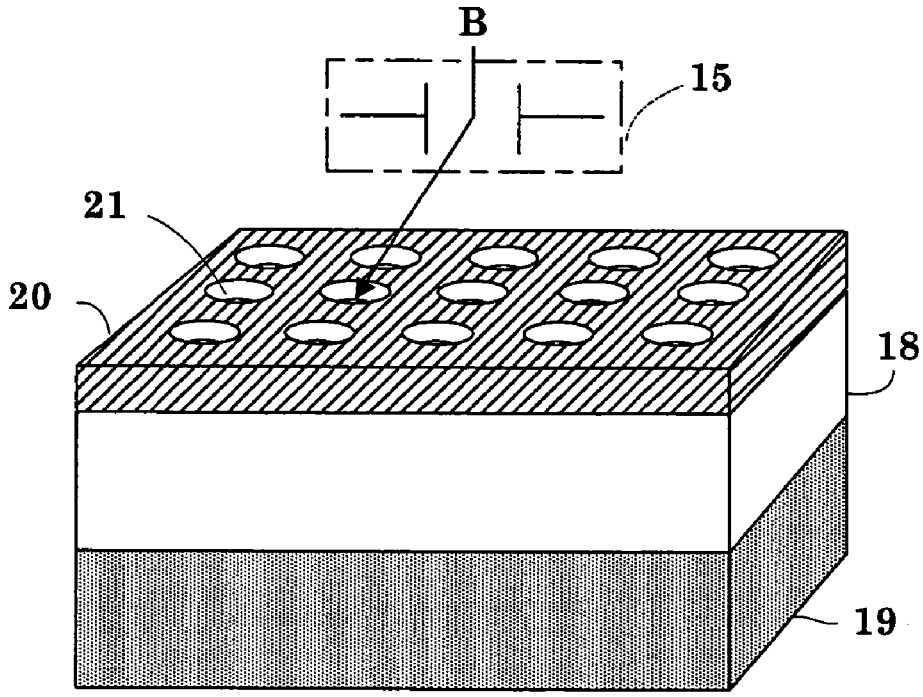
FIG. 16 is a schematic view showing a position adjustment of an electron beam.

One of the electron beam-moving device, as shown in FIG. 16, is a deflector 15 for deflecting the course of electron beam B, which corresponds to claim 16. Since the course of electron beam B can be deflected by the deflector 15, the position in which the electron beam B collides with the target is movable. The deflector 15 is ideal since it can adopt many modes utilizing magnetism or static electricity, easily cause two-dimensional movements on the target, and deflect the course of electron beam B at high speed.

Figure 18:
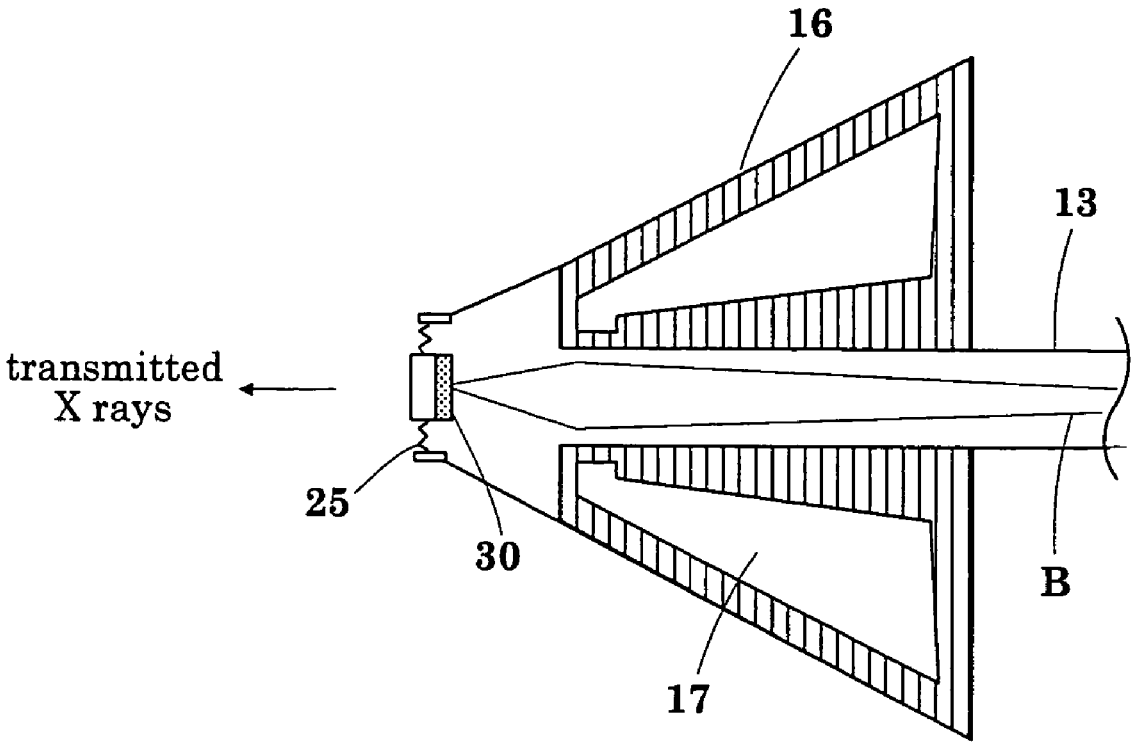
FIG. 18 is a schematic view showing a target shifting method.

A mechanical positioning device is the best suited for the target moving device. As shown in FIG. 18, for example, a bellows 25 may be provided between the backing plate 19 and the X-ray tube body, and while maintaining the vacuum, the target may be moved by using a micrometer or a miniature motor.

This invention is not limited to the embodiments described above, but may be modified as set out in (1)-(6) below:

(1) In each of the above embodiments, the electron beam B is allowed to collide directly with the target including the surface solid 20 defining the cylindrical opening 21. FIG. 16 shows a particularly useful modification of the target in which the surface solid 20 defines a plurality of such openings 21. When one opening 21 becomes unusable due to electron beam irradiation, other opening can be used to generate X-rays. That is, one target can be used repeatedly to extend the life of the X-ray tube.

Figure 19A:
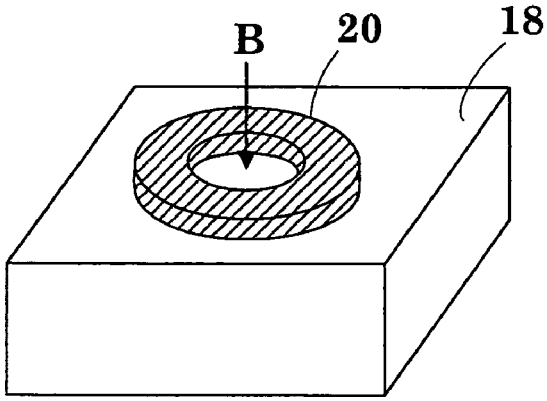
FIGS. 19A through 19C are perspective views showing modified surface solids.
Figure 19B:
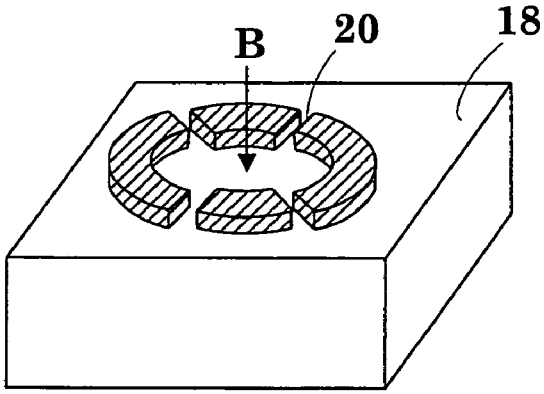
Figure 19C:
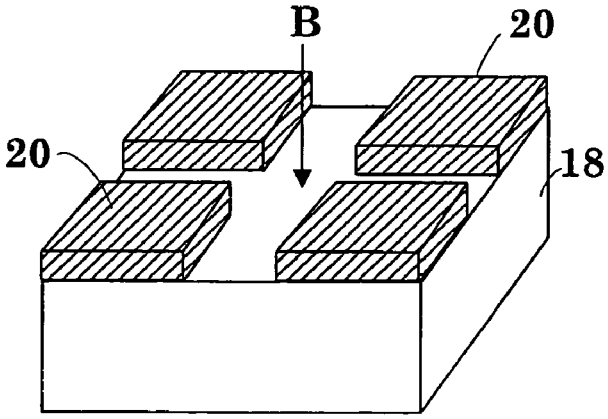

(2) As shown in FIG. 19A, a ring-shaped surface solid 20 may be employed. Further, as shown in FIG. 19B, the ring-shaped surface solid 20 may be divided into a plurality of parts arranged around the surface where the electron beam B collides. As shown in FIG. 19C, square surface solids 20 may be arranged in a two-dimensional array. Such divided configuration simplifies the target manufacturing process since a deposition mask coping with such a divided shape is prepared easily. The divided configuration has a further advantage of securing a plurality of electron beam colliding locations to use the target over a long period of time.

Figure 20:
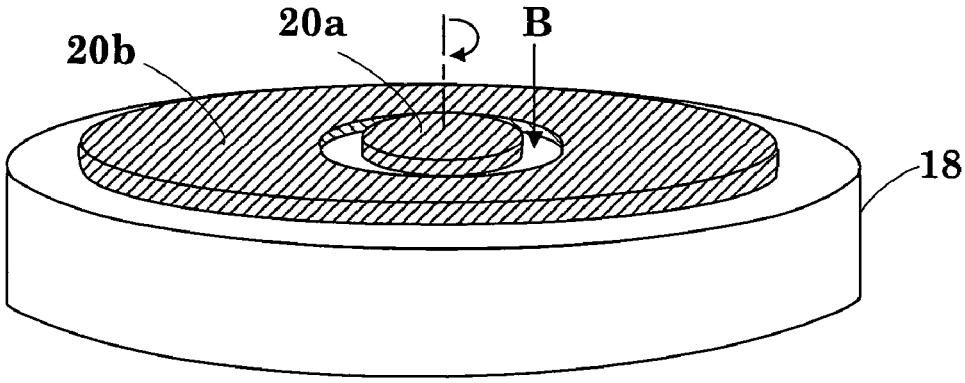
FIG. 20 is a perspective view showing a modified surface solid.

(3) As shown in FIG. 20, a rotating anode target may have a small surface solid 20*a* formed centrally thereof, and a large ring-shaped surface solid 20*b* formed around the small surface solid 20*a*, the electron beam B colliding with a target portion exposed between the two surface solids. This construction can move the electron beam colliding position continuously, thereby using the target over a long period of time.

Figure 21A:
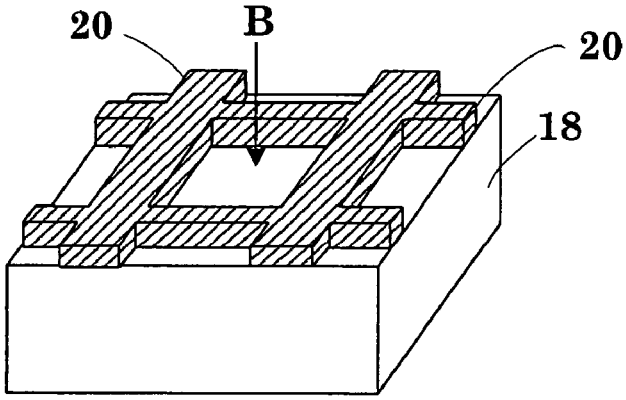
FIGS. 21A and 21B are perspective views showing modified surface solids.
Figure 21B:
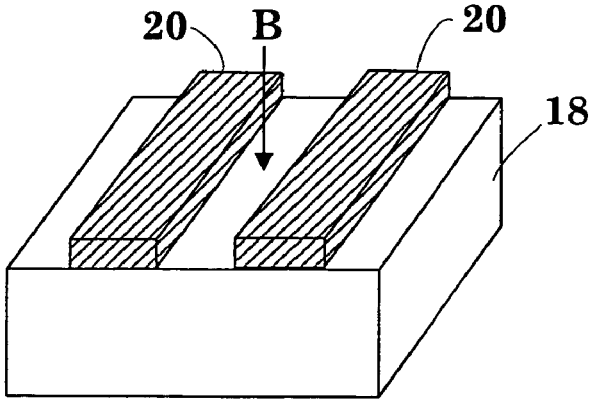

(4) As shown in FIG. 21A, a surface solid 20 may be formed in the shape of a lattice on the surface of the target layer 18. Further, as shown in FIG. 21B, linear surface solids 20 of predetermined width and length may be arranged in parallel. Such a construction can secure a plurality of positions to be irradiated by the electron beam B. By changing the positions of irradiation in a timely way, one target may be used over a long period of time.

FIGS. 21A and 21B each show a part of the target near an electron beam colliding position. Preferably, the target has a plurality of such patterns.

(5) The examples described hereinbefore are applicable also to a reflection type X-ray generating apparatus.

(6) While the examples described hereinbefore all relate to an X-ray generating apparatus, this invention is applicable also to an electron passage window of an electron beam emitting apparatus.

This invention may be embodied in other specific forms without departing from the spirit or essential attributes thereof and, accordingly, reference should be made to the appended claims, rather than to the foregoing specification, as indicating the scope of the invention.

What is claimed is:

1. A method for manufacturing an X-ray generating apparatus for generating X-rays comprising the steps of:

forming a heat-dissipation layer on a surface of a target on which an electron beam is irradiated;

attaching said target on which said heat-dissipation layer is formed to an X-ray tube; and terminating irradiation of the electron beam when said beam passes through said heat-dissipation layer and reaches the surface of said target, and setting the surface of said target exposed through a formed bore to a focal position of said electron beam.

* * * * *